US009476350B2

(12) United States Patent
Schumacher et al.

(10) Patent No.: US 9,476,350 B2
(45) Date of Patent: Oct. 25, 2016

(54) TURBOCHARGER FOR AN INTERNAL COMBUSTION ENGINE AND METHOD FOR OPERATING A TURBOCHARGED INTERNAL COMBUSTION ENGINE

(71) Applicant: Ford Global Technologies, LLC, Dearborn, MI (US)

(72) Inventors: Bernd Schumacher, Langenfeld (DE); Marco Marceno, Hagen (DE); Jan Linsel, Cologne (DE); Kay Hohenboeken, Cologne (DE); Oliver Berkemeier, Bergisch Gladbach (DE); Jens Wojahn, Bergisch Gladbach (DE); Klemens Grieser, Langenfeld (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/861,291

(22) Filed: Apr. 11, 2013

(65) Prior Publication Data

US 2013/0269340 A1 Oct. 17, 2013

(30) Foreign Application Priority Data

Apr. 17, 2012 (DE) ..... 10 2012 206 274

(51) Int. Cl.

| | |
|---|---|
| ***F02B 33/44*** | (2006.01) |
| ***F04B 17/05*** | (2006.01) |
| ***F01P 1/06*** | (2006.01) |
| ***F02B 33/00*** | (2006.01) |
| ***F02B 39/14*** | (2006.01) |
| *F01P 5/10* | (2006.01) |

(52) U.S. Cl.
CPC ..... *F02B 33/00* (2013.01); *F02B 39/14* (2013.01)

(58) Field of Classification Search
CPC ..... F02B 39/14
USPC ..... 60/605.3; 123/41.31, 41.34, 41.42, 123/196 R, 196 A; 417/407; 184/6.1, 6.11, 184/6.5, 6.3
See application file for complete search history.

(56) References Cited

U.S. PATENT DOCUMENTS

| | | | | | |
|---|---|---|---|---|---|
| 3,057,436 | A | * | 10/1962 | Jacobson et al. | 184/6.3 |
| 4,126,997 | A | * | 11/1978 | Henson | 60/605.3 |
| 4,331,112 | A | * | 5/1982 | Pluequet | 123/196 S |
| 4,422,295 | A | * | 12/1983 | Minami et al. | 60/605.3 |
| 4,884,406 | A | * | 12/1989 | Kawamura | 60/605.3 |
| 5,275,133 | A | * | 1/1994 | Sasaki et al. | 123/41.31 |

(Continued)

FOREIGN PATENT DOCUMENTS

| | | | |
|---|---|---|---|
| DE | 19959485 | A1 | 6/2001 |
| DE | 19959485 | C2 * | 1/2002 |

(Continued)

OTHER PUBLICATIONS

JP 2001193470 A English Translation.*
DE 102011119521 A1 English Translation.*

*Primary Examiner* — Thomas Denion
*Assistant Examiner* — Jessica Kebea
(74) *Attorney, Agent, or Firm* — Julia Voutyras; Alleman Hall McCoy Russell & Tuttle LLP

(57) ABSTRACT

A turbocharger for an internal combustion engine includes an oil-lubricated bearing, a feed line for the oil and a throughflow limiter for the oil.

16 Claims, 2 Drawing Sheets

(56) References Cited

U.S. PATENT DOCUMENTS

| | | | | |
|---|---|---|---|---|
| 5,499,693 | A * | 3/1996 | Widenhorn | 184/6.24 |
| 8,015,810 | B2 * | 9/2011 | Theobald | 60/605.3 |
| 8,474,259 | B2 * | 7/2013 | Kistner et al. | 60/605.3 |
| 2007/0234997 | A1 * | 10/2007 | Prenger | 123/196 S |
| 2008/0083586 | A1 * | 4/2008 | Kobayashi et al. | 184/6.4 |
| 2008/0283337 | A1 * | 11/2008 | Theobald | 184/6.1 |
| 2009/0194044 | A1 * | 8/2009 | Nishida | 123/41.02 |
| 2010/0114454 | A1 * | 5/2010 | French et al. | 701/102 |
| 2011/0094225 | A1 * | 4/2011 | Kistner et al. | 60/605.3 |
| 2012/0067327 | A1 * | 3/2012 | Kaiser et al. | 123/350 |
| 2012/0177476 | A1 * | 7/2012 | Jones | 415/1 |

FOREIGN PATENT DOCUMENTS

| | | | | | |
|---|---|---|---|---|---|
| DE | 10331396 | A1 * | 2/2005 | | F02B 37/12 |
| DE | 102011119521 | * | 5/2013 | | F01D 25/18 |
| JP | 59141724 | A * | 8/1984 | | |
| JP | S59190427 | A | 10/1984 | | |
| JP | 60060219 | A * | 4/1985 | | |
| JP | 60138229 | A * | 7/1985 | | F02B 39/14 |
| JP | 60145406 | A * | 7/1985 | | F01D 25/18 |
| JP | 61123719 | A * | 6/1986 | | F02B 39/14 |
| JP | 01080720 | A * | 3/1989 | | F02B 39/14 |
| JP | 02173323 | A * | 7/1990 | | F02B 39/14 |
| JP | 08093490 | A * | 4/1996 | | F02B 39/14 |
| JP | 2001193470 | A * | 7/2001 | | F02B 39/14 |

* cited by examiner

TURBOCHARGER FOR AN INTERNAL COMBUSTION ENGINE AND METHOD FOR OPERATING A TURBOCHARGED INTERNAL COMBUSTION ENGINE

CROSS REFERENCE TO RELATED APPLICATIONS

The present application claims priority to German Patent Application No. 102012206274.2, filed on Apr. 17, 2012, the entire contents of which are hereby incorporated by reference for all purposes.

FIELD

The invention relates to a turbocharger for an internal combustion engine, to an internal combustion engine having a turbocharger and to a method for operating a turbocharged internal combustion engine.

BACKGROUND AND SUMMARY

New requirements and legislation regarding emissions in motor vehicles embody ever more stringent limit values for the particle emissions of internal combustion engines. Examples are LEV3 in the United States and EU6 in Europe which have recently been introduced. In turbocharged internal combustion engines, particularly gasoline engines with direct injection, a considerable fraction of the particles generated arises in that oil passes in an undesirable way into the combustion chambers and potentially directly into the exhaust gas.

In some example, one potential issue addressed is to reduce the particle emissions which are caused by oil. This is at least partially achieved by a system, comprising: an internal combustion engine having a turbocharger; an oil-lubricated bearing; a feed line for the oil; and a throughflow limiter for the oil. In other examples, a method for a turbocharged internal combustion engine is provided, comprising: during engine operating conditions, while oil is being fed to an oil bearing of a turbocharger; controlling throughflow and/or pressure of the oil via a throughflow limiter based on engine operating conditions, for example via an electronic controller.

Advantageous developments of the invention are defined in the dependent claims.

For example, it was found that oil escaping from the bearing of the turbocharger may contribute considerably to the particle emissions, specifically to an extent which may correspond to the EU6 limit values for particle emissions in the amount of $6*10^{11}$#/km in the NEDC (New European Driving Cycle).

DETAILED DESCRIPTION

Figure 1:
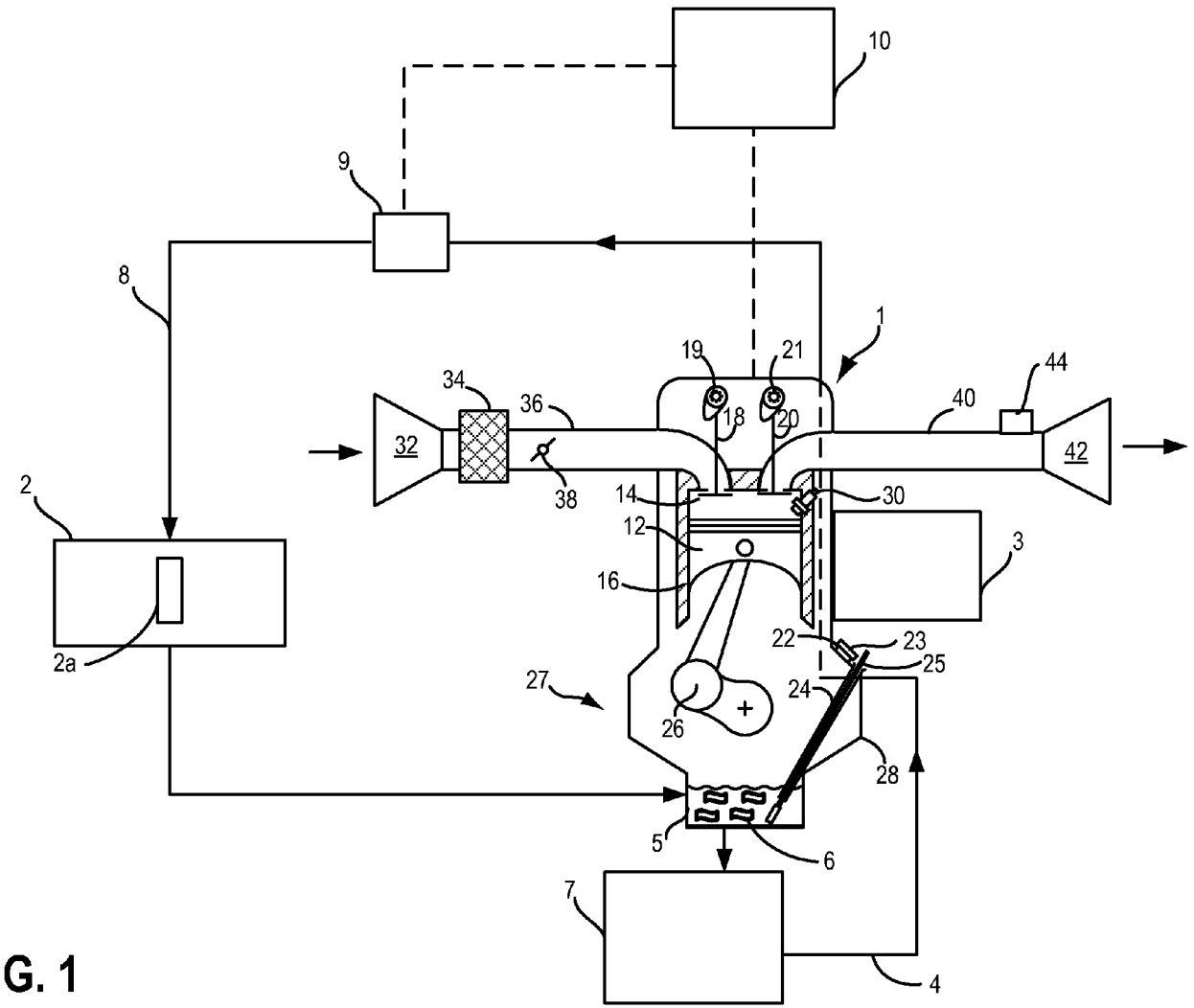
FIG. 1 shows an internal combustion engine system including a throughflow limiter.

According to a first aspect of the invention, a turbocharger for an internal combustion engine comprises an oil-lubricated bearing, a feed line for the oil, and a throughflow limiter for the oil. Instead of supplying the bearing of the turbocharger directly with oil from the engine oil circuit, as hitherto, the invention proposes to provide a throughflow limiter in order to avoid excess oil in the bearing of the turbocharger. Since the bearing does not require such a high oil pressure as other components of the engine for lubrication purposes, there will be the risk, at this high oil pressure, that oil escapes from the bearing and passes into the combustion chamber and the exhaust gas, thus increasing the particle emissions and, possibly, further emissions. The oil pressure, reduced according to the invention, in the bearing of the turbocharger results in a lower escape of oil into the air intake system at the compressor wheel and into the exhaust gas system at the turbine wheel. The term "oil" embraces all types of oils and other customary lubricants which are suitable for lubricating an internal combustion engine or its components.

The throughflow limiter may be arranged in the feed line. This arrangement is simple to implement. Alternatively, the throughflow limiter may be an integral part of the turbocharger or of the engine.

The throughflow limiter limits the pressure or throughflow rate of the oil. Consequently, the expected escape of oil from the bearing of the turbocharger can be set at a minimum.

The throughflow limiter may have a throttle valve or a simple diaphragm with reduced cross section. The pressure or throughflow of the oil can thus be limited in a simple way.

The throughflow limiter may have two individually switchable throughflow stages. Consequently, the lubrication of the bearing of the turbocharger can be adapted to circumstances, such as the operating state of the engine, turbocharger or external conditions, such as weather or altitude. A plurality of stages or continuous regulation or control may also be provided. To vary the throughflow, for example, a (throttle) valve switchable in two stages or a valve to be regulated continuously may be used.

According to a further aspect of the invention, an internal combustion engine comprises a turbocharger, as described above. The same advantages and modifications as those described above apply.

A control of the internal combustion engine may control the throughflow limiter. The engine control or another control of the vehicle may control or regulate the throughflow as a function of the respective operating situation of the engine and/or turbocharger and of further parameters.

According to a further aspect of the invention, a method for operating a turbocharged internal combustion engine comprises the following steps:

feed of oil to a bearing of the turbocharger;

limitation of the throughflow and/or pressure of the oil.

The same advantages and modifications as those described above apply.

Limitation may be adjustable. The magnitude of the pressure or the throughflow rate of the oil may be varied or set in stages or continuously. Thus, the lubrication of the bearing or the risk of an escape of oil from the bearing can be optimized.

Limitation may be set, for example, as a function of the load of the internal combustion engine. Further operating states and/or temperatures of the engine and/or of the turbocharger may also be used as parameters for regulation or control. The lubrication of the bearing of the turbocharger can thus be metered in a managed way. The lubrication or, more specifically, the pressure and/or throughflow of the lubricant are minimized, so that proper lubrication is ensured, but an escape of lubricant from the bearing is minimized.

The drawings serve merely for explaining the invention and do not restrict this. The drawings and individual parts are not necessarily true to scale. The same reference symbols designate identical or similar parts.

Figure 2:
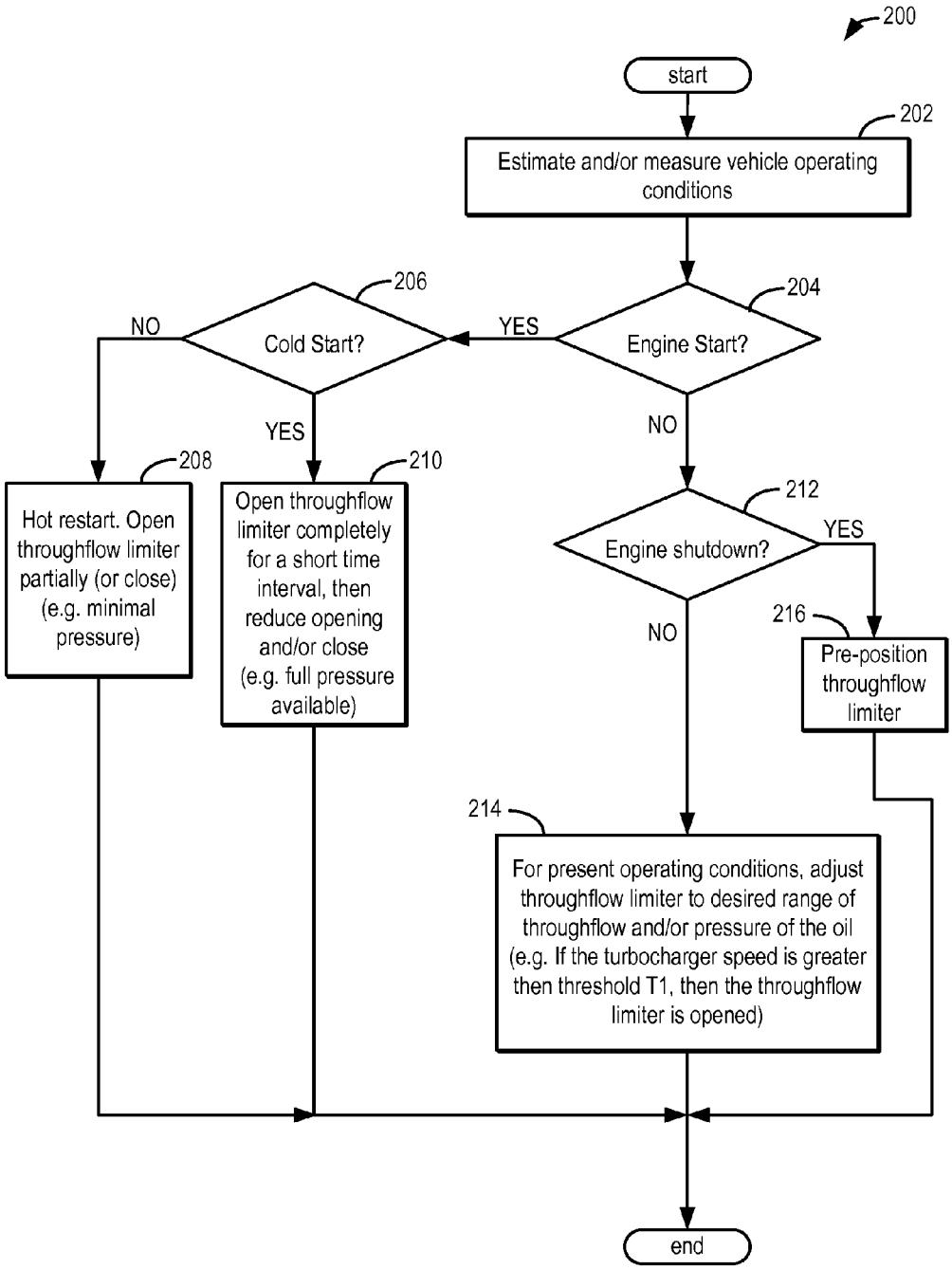
FIG. 2 shows a flow chart of a method to control a throughflow limiter.

The following description relates to systems and methods for controlling a throughflow limiter in a turbocharged internal combustion engine (FIG. 1). The throughflow limiter regulates the pressure or throughflow rate of the oil to the turbocharger bearing based on specific operating conditions (FIG. 2).

FIG. 1 shows an internal combustion engine 1 of a motor vehicle. The motor may be a gasoline engine, for example with direct injection, or else a diesel engine. Engine 1 is supercharged by means of a turbocharger 2.

Engine 1 may be controlled at least partially by a control system including engine controller 10. Engine 1 may include a lower portion of the engine block, indicated generally at 27, which may include a crankcase 28 encasing a crankshaft 26 with oil well 5 positioned below the crankshaft. An oil fill port 22 may be disposed in crankcase 28 so that oil may be supplied to oil well 5. Oil fill port 22 may include an oil cap 23 to seal oil fill port 22 when the engine is in operation. A dip stick tube 24 may also be disposed in crankcase 28 and may include a dipstick 25 for measuring a level of oil in oil well 5. In addition, crankcase 28 may include a plurality of other orifices for servicing components in crankcase 28. These orifices in crankcase 28 may be maintained closed during engine operation so that a crankcase ventilation system (described below) may operate during engine operation.

The upper portion of engine block 27 may include a combustion chamber (e.g., cylinder) 14. The combustion chamber 14 may include combustion chamber walls 16 with piston 12 positioned therein. Piston 12 may be coupled to crankshaft 26 so that reciprocating motion of the piston is translated into rotational motion of the crankshaft. Combustion chamber 14 may receive fuel from fuel injector 30 (configured herein as a direct fuel injector) and intake air from intake manifold 36 which is positioned downstream of throttle 38.

A throttle 38 may be disposed in the engine intake to control the airflow entering intake manifold 36 and may be preceded upstream by compressor 32 followed by charge air cooler 34, for example. The intake air may enter combustion chamber 14 via cam-actuated intake valve system 18. Likewise, combusted exhaust gas may exit combustion chamber 14 via cam-actuated exhaust valve system 20. Intake valve 18 and exhaust valve 20 may be controlled by cam actuation via respective cam actuation systems 19 and 21. Cam actuation systems 19 and 21 may each include one or more cams and may utilize one or more of cam profile switching (CPS), variable cam timing (VCT), variable valve timing (VVT) and/or variable valve lift (VVL) systems that may be operated by controller 10 to vary valve operation. To enable detection of cam position, cam actuation systems 19 and 21 should have toothed wheels. In an alternate embodiment, one or more of the intake valve system and the exhaust valve system may be electrically actuated.

Exhaust combustion gases exit the combustion chamber 14 via exhaust passage 40 located upstream of turbine 42. An exhaust gas sensor 44 may be disposed along exhaust passage 40 upstream of turbine 42. Turbine 42 may be equipped with a wastegate bypassing it. Exhaust gas sensor 44 may be a suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Exhaust gas sensor 44 may be connected with engine controller 10. Connected to engine 1 is a transmission 3 which either can be attached directly to engine 1 or is connected to engine 1 via a shaft.

A lubricant circuit or oil circuit 4 of engine 1 is explained below. The oil 6 collects in an oil well 5 underneath engine 1 and is conducted from there to an oil pump 7. The oil pump 7 pumps the oil into crankcase 28 where it runs through the cylinder head of engine 1. The transmission 3 may likewise be connected to the oil circuit 4.

The oil circuit 4 or at least a branch parallel to the engine 1 runs to throughflow limiter 9. Throughflow limiter 9 is positioned outside engine 1 and between the engine block 27 and oil turbocharger bearing. Further, throughflow limiter 9 is arranged in feed line 8 which conducts the oil 6 from engine 1 or from another point of the oil circuit 4 to turbocharger 2. Thus, oil circuit 4 via feed line 8 supplies turbocharger 2 with oil 6 in order to lubricate one or more turbocharger oil bearings 2*a*. Oil 6 is then conveyed from turbocharger 2 into oil well 5.

The throughflow limiter 9 may have a simple throttle or diaphragm for limitation of pressure or of throughflow. Alternatively, a valve or a similar actuating means which is set by calibration or maintenance may be used.

However, throughflow limiter 9 may also have two or more individually switchable throughflow stages, which may be implemented, for example, by means of a multiway valve. Thus, throughflow limiter 9 can be adapted, for example, to operating conditions, such as the load or temperature of engine 1 and/or turbocharger 2. Further parameters of engine 1, of turbocharger 2, of transmission 3 or further components of the vehicle may be taken into account in the control or regulation of throughflow limiter 9. Throughflow limiter 9 may also be set continuously, so that the oil flow can be adapted constantly.

A controller 10, such as, for example, the engine control or a certain part of this, such as, for example, a software routine, may carry out the activation of throughflow limiter 9. For this purpose, controller 10 communicates at least with engine 1 and with throughflow limiter 9, as illustrated by the dashed lines. Further connections, such as, for example, to turbocharger 2 or to temperature sensors or further controls, are possible, but are not illustrated.

When the vehicle or engine 1 runs in operation, oil 6 is fed to the turbocharger oil bearing 2*a* of turbocharger 2. The throughflow and/or pressure of the oil 6 which is built up by the oil pump 7 is limited by throughflow limiter 9, so that turbocharger oil bearing 2*a* continues to be lubricated sufficiently, but there is no or only insignificant excess pressure or not too much oil 6 at or in turbocharger oil bearing 2*a*. Thus, proper operation is ensured, while the escape of oil from turbocharger oil bearing 2*a* is minimized, thus reducing the particle emissions considerably.

With a cold start, for the rapid activation of turbocharger 2 there may be provision for opening throughflow limiter 9 completely, so that, at least for a short time, the full pressure or the entire throughflow rate of oil 6 is available to turbocharger bearing 2*a*.

In further operation, the throughflow limiter 9, in so far as it is designed to be adjustable or controllable, is activated or regulated by the controller 10 so that the lubrication of turbocharger oil bearing 2*a* takes place as required. In this case, in particular, the operating state, such as the load, of engine 1 is taken into account. The selected parameter may be the rotational speed of engine 1. As stated above, further or other parameters, for example of the turbocharger, may be used. The limitation of the throughflow may be carried out as regulation or as control.

Now turning to FIG. 2, the method shows how a throughflow limiter is controlled during the engine's natural variation, such as the engine shown in FIG. 1. For example, an engine in a vehicle can have widely varying oil pressure depending on the operating conditions of the vehicle. Under some driving scenarios, high oil pressure results in excess oil in the bearing of the turbocharger. One such example is that the high oil pressure causes oil to escape form the bearing and pass into the combustion chamber and the exhaust gas; thus, increasing the particle emissions. However, through the use of the throughflow limiter, oil pressure changes can be regulated and the escape of oil into the air intake system is limited. In one embodiment, the throughflow limiter can have set parameters to regulate oil pressure based on operating conditions (e.g. load, boost, engine temperature, etc.). And the selected parameters of the limiter minimize the pressure of the oil so the escape of oil from the bearing is decreased.

Method 200 begins at 202 and the method includes estimating and/or inferring vehicle and engine operating conditions. These may include, for example, driver torque demand, vehicle speed, battery state of charge (SOC), engine speed, engine temperature, catalyst temperature, boost level, MAP, MAF, ambient conditions (temperature, pressure, humidity, etc.). As such, based on the vehicle operating conditions, a vehicle mode of operation may be determined. Once the operating conditions are determined, at 204, it is determined if the engine needs to start. If the engine does need to start, at 206, it is determined if a cold start needs to be performed. At 210, if a cold start is required, the cold start parameter is selected and the throughflow limiter is adjusted for cold start activation. For example, with a cold start activation, the engine temperature is low thus requiring rapid activation of turbocharger 2. Therefore, at 210, controller 10 may have a specific parameter for an engine cold start that decreases the restriction of throughflow limiter 9 in order to allow full pressure and/or the entire throughflow rate of oil to be available to the turbocharger oil bearing 2*a*. Once the throughflow rate is adjusted for a cold start, the oil is sent to the turbocharger oil bearing 2*a* through oil feed line 8. However, at 206, if a cold start is not required (e.g. hot restart) a separate parameter is selected; thus, increasing the restriction of throughflow limiter relative to the restriction during the cold engine start (208). For example, for a hot restart, the turbocharger does not require maximal oil pressure at the turbocharger oil bearing. Thus, controller 10 may have a specific parameter for an engine restart, separate from a cold start parameter. Controller 10 sends a signal to throughflow limiter 9 adjusting the throughflow limiter to allow only sufficient amount of throughflow to turbocharger oil bearing 2*a*.

Returning to 204, if it is determined that the engine is already started, at 212, it is determined whether the engine needs to be shutdown. If it is determined that the engine does not need to be shut down, at 214, the throughflow limiter is adjusted based on the present operating conditions. In one embodiment, the degree of adjustment to the throughflow limiter generates a desired range of throughflow and/or pressure of the oil responsive to engine load. Further, the limiter has a two-stage switchable throttle that is adjusted to a specific parameter in response to operating conditions (e.g. load, boost, engine temperature, etc.). In one example, a high load of the engine results in the turbocharger and its bearing system to become very hot; therefore, high load conditions need to have a higher oil flow. Thus, when the turbocharger speed is greater than a set threshold, throughflow limiter 9 is opened completely to allow for maximal throughflow to turbocharger oil bearing 2*a* via feed line 8. However, if the turbocharger speed does not exceed a set threshold then the throughflow limiter 9 opening is restricted (e.g. opened partially) in order to allow a sufficient amount of throughflow to turbocharger oil bearing 2*a*. Returning to 212, if the engine is shutdown, the throughflow limiter is pre-positioned based on starting conditions (216). For example, controller 10 may have a specific parameter for an engine shutdown, separate from a cold or hot start parameter, that increases or decreases restriction (e.g closes and/or opens) of throughflow limiter 9; thus, preparing it for an engine start.

Note that the example control and estimation routines included herein can be used with various system configurations. The specific routines described herein may represent one or more of any number of processing strategies such as event-driven, interrupt-driven, multi-tasking, multi-threading, and the like. As such, various actions, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, functions, or operations may be repeatedly performed depending on the particular strategy being used. Further, the described operations, functions, and/or acts may graphically represent code to be programmed into computer readable storage medium in the control system and stored in memory therein, non-transitorily.

Further still, it should be understood that the systems and methods described herein are exemplary in nature, and that these specific embodiments or examples are not to be considered in a limiting sense, because numerous variations are contemplated. Accordingly, the present disclosure includes all novel and non-obvious combinations of the various systems and methods disclosed herein, as well as any and all equivalents thereof.

The invention claimed is:

1. A system, comprising:

an internal combustion engine having a turbocharger;

an oil-lubricated bearing;

a feed line for oil positioned between an engine block and the turbocharger;

a throughflow limiter for the oil positioned in the feed line; and a controller programmed with a computer readable storage medium for adjusting the throughflow limiter including:

during a cold engine start, decreasing restriction of the throughflow limiter;

during a hot engine restart, increasing restriction of the throughflow limiter relative to the restriction during the cold engine start;

if the internal combustion engine is already started, adjusting the restriction of the throughflow limiter continuously based on engine operating conditions including engine load; and pre-positioning the restriction of the throughflow limiter by decreasing the restriction responsive to an engine shutdown.

2. The system of claim 1, wherein the throughflow limiter is arranged in the feed line upstream of the turbocharger.

3. The system of claim 1, wherein the throughflow limiter limits pressure of the oil.

4. The system of claim 1, wherein the throughflow limiter includes a throttle valve.

5. The system of claim 1, where the throughflow limiter is positioned outside of the engine block of the internal combustion engine.

6. The system of claim 5, wherein the adjusting the restriction of the throughflow limiter continuously based on the engine operating conditions including engine load includes decreasing the restriction of the throughflow limiter continuously with increasing engine load.

7. The system of claim 6, further comprising completely opening the throughflow limiter in response to turbocharger speed being greater than a set threshold.

8. A method for a turbocharged engine, comprising:

during engine operating conditions, while oil is being fed to an oil bearing of a turbocharger, controlling throughflow to the turbocharger and/or pressure of the oil via a throughflow limiter positioned in a flow passage between an engine block and a bearing of the turbocharger, the controlling including:

during a cold engine start, adjusting the throughflow limiter to a first amount of throughflow;

during a hot engine restart, adjusting the throughflow limiter to a second amount of throughflow, less than the first amount of throughflow;

if the turbocharged engine is already started, adjusting the throughflow limiter continuously based on the engine operating conditions, the engine operating conditions including engine load; and pre-positioning the throughflow limiter by decreasing a restriction responsive to an engine shutdown.

9. The method of claim 8, wherein the throughflow limiter is adjustable via a control signal from a control system.

10. The method of claim 9, wherein if the turbocharger is already started, the throughflow limiter restriction decreases with increasing engine load.

11. The method of claim 10, further comprising adjusting a throttle in the throughflow limiter responsive to engine load.

12. The method of claim 10, further comprising completely opening the throughflow limiter in response to turbocharger speed being greater than a set threshold.

13. The method of claim 12, wherein a degree of adjustment generates a desired range or amount of throughflow and/or pressure of the oil in response to engine load.

14. The method of claim 13, wherein the oil is sent to the turbocharger oil bearing through an oil feed line.

15. A method, comprising:

while oil is being fed to an oil bearing of a turbocharger from a cylinder block:

responsive to a cold engine start determined from a controller, decreasing restriction of a throughflow limiter;

responsive to a hot engine restart determined from the controller, increasing restriction of the throughflow limiter, relative to the restriction during the cold engine start;

responsive to an engine already being started as determined from the controller, during high load, decreasing restriction of the throughflow limiter, relative to the restriction during the hot engine restart; and responsive to an engine shutdown, decreasing restriction of the throughflow limiter to pre-position the restriction.

16. The method of claim 15, further comprising, while the oil is being fed to the oil bearing from the cylinder block, during low engine load, increasing restriction of the throughflow limiter, relative to the restriction during the cold engine start and the high load.

* * * * *